US009742120B2

(12) United States Patent
Tsai et al.

(10) Patent No.: US 9,742,120 B2
(45) Date of Patent: Aug. 22, 2017

(54) ELECTRICAL PLUG CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Ya-Fen Kao, New Taipei (TW); Long-Fei Chen, New Taipei (TW); Yang-Yang Zhou, New Taipei (TW); Chun-Wei Wei, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/139,928

(22) Filed: Apr. 27, 2016

(65) Prior Publication Data

US 2016/0322756 A1 Nov. 3, 2016

(30) Foreign Application Priority Data

Apr. 28, 2015 (CN) ..... 2015 1 0207146

(51) Int. Cl.

| | |
|---|---|
| ***H01R 3/00*** | (2006.01) |
| ***H01R 13/6581*** | (2011.01) |
| ***H01R 24/60*** | (2011.01) |
| *H01R 107/00* | (2006.01) |
| *H01R 13/405* | (2006.01) |
| *H01R 13/46* | (2006.01) |

(52) U.S. Cl.

CPC ..... *H01R 13/6581* (2013.01); *H01R 24/60* (2013.01); *H01R 13/405* (2013.01); *H01R 13/465* (2013.01); *H01R 2107/00* (2013.01)

(58) Field of Classification Search

CPC .... H01R 13/6581; H01R 12/53; H01R 24/60; H01R 13/465; H01R 9/032; H01R 12/27; H01R 13/405; H01R 2107/00

USPC ..... 439/488

See application file for complete search history.

(56) References Cited

U.S. PATENT DOCUMENTS

| | | | | |
|---|---|---|---|---|
| 8,900,013 | B2 * | 12/2014 | Li | H01R 12/53 439/660 |
| 9,147,979 | B1 * | 9/2015 | Chung | H01R 12/727 |
| 9,502,837 | B2 * | 11/2016 | Kao | H01R 24/60 |
| 2006/0121783 | A1 * | 6/2006 | Wu | H01R 9/032 439/607.41 |
| 2010/0210124 | A1 * | 8/2010 | Li | H01R 23/6873 439/108 |

* cited by examiner

*Primary Examiner* — Jean F Duverne

(74) *Attorney, Agent, or Firm* — Andrew M. Calderon; Roberts Mlotkowski Safran Cole & Calderon, P.C.

(57) ABSTRACT

An electrical plug connector includes an insulated housing and a plurality of plug terminals. The insulated housing includes a base portion and a semi-tubular portion extending from one side of the base portion. The semi-tubular portion includes a portion, a front stopping portion at a front lateral surface of the portion, and a plurality of side blocks extending outward from two sides of the portion. The plug terminals include a plurality of signal terminals, one or more power terminal, and one or more ground terminal. The plug terminals are held in the insulated housing and at the surface of the portion.

17 Claims, 17 Drawing Sheets

ELECTRICAL PLUG CONNECTOR

CROSS-REFERENCES TO RELATED APPLICATIONS

This non-provisional application claims priority under 35 U.S.C. §119(a) on Patent Application No. 201510207146.8 filed in China, P.R.C. on 2015 Apr. 28, the entire contents of which are hereby incorporated by reference.

FIELD OF THE INVENTION

The instant disclosure relates to an electrical connector, and more particular to an electrical plug connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector.

A conventional USB type-C electrical plug connector includes a plastic core, plug terminals formed with the plastic core, and an outer iron shell enclosing the plastic core. As a result, the manufacturing time and cost of the conventional USB type-C electrical plug connector increase.

SUMMARY OF THE INVENTION

Consequently, how to improve the existing electrical plug connector becomes an issue.

In view of these, an exemplary embodiment of the instant disclosure provides an electrical plug connector comprising an insulated housing and a plurality of first plug terminals. The insulated housing comprises a base portion and a semi-tubular portion extending from one side of the base portion. The semi-tubular portion comprises a portion, a front stopping portion at a front lateral surface of the portion, and a plurality of side blocks extending outward from two sides of the portion. The first plug terminals comprise a plurality of signal terminals, at least one power terminal, and at least one ground terminal. The first plug terminals are held in the insulated housing and at a first mating surface of the first portion.

Another embodiment of the instant disclosure also provides an electrical plug connector comprising an insulated housing and a plurality of first plug terminals. The insulated housing comprises a base portion, a tubular portion, and a mating room. The tubular portion comprises a first portion and a second portion. The tubular portion is extending from one side of the base portion. The mating room is between the first portion and the second portion. The first plug terminals comprise a plurality of signal terminals, at least one power terminal, and at least one ground terminal. The first plug terminals are held in the insulated housing and at a first mating surface of the first portion.

Yet another embodiment of the instant disclosure provides an electrical plug connector comprises the aforementioned insulated housing and a color layer formed on the insulated housing.

According to embodiments of the instant disclosure, the electrical plug connector does not have the outer iron shell for enclosing the insulated housing. According to embodiments of the instant disclosure, the electrical plug connector comprises the insulated housing and the plug terminals, the structure (either the semi-tubular portion or the tubular portion) of the insulated housing can be mated with an electrical receptacle connector (Type-C receptacle connector) for signal and/or power transmission. The plug terminals may be aligned in a single row or as two rows. The components in the insulated housing, for example, the plug terminals, the engaging portions, etc., may be assembled to the insulated housing, or may be integrated with the insulated housing by insert-molding techniques.

According to embodiments of the instant disclosure, the outer iron shell, the EMI pieces and insulated pieces at the outer iron shell are reduced, so that the electrical plug connector can be assembled rapidly, and the cost can meet the criteria of a cheaper connector. The appearance of the insulated housing conformed to the specification of USB Type-C connector, and the insulated housing can be firmly mated with an electrical receptacle connector (Type-C receptacle connector). In addition, the plug terminals are aligned in a single row, and the number of the plug terminals can be reduced for basic power or signal transmission, according to user requirements. Alternatively, the plug terminals may be aligned in two rows, and the number of the plug terminals can be reduced for basic power or signal transmission, according to user requirements.

In addition, in some embodiments, the insulated housing comprises the semi-tubular portion. The insulated housing having the semi-tubular portion can also meet the USB Type-C connection interface and can be mated with an electrical receptacle connector (Type-C receptacle connector). Consequently, the cost of the insulated housing can be reduced, and the structure of the insulated housing is simple and can be manufactured easily.

Moreover, a color layer may be provided on the insulated housing to improve the beauty of the electrical plug connector. In addition, the color may be provided for distinguishing electrical plug connector with different connection interfaces or different transmission specifications.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
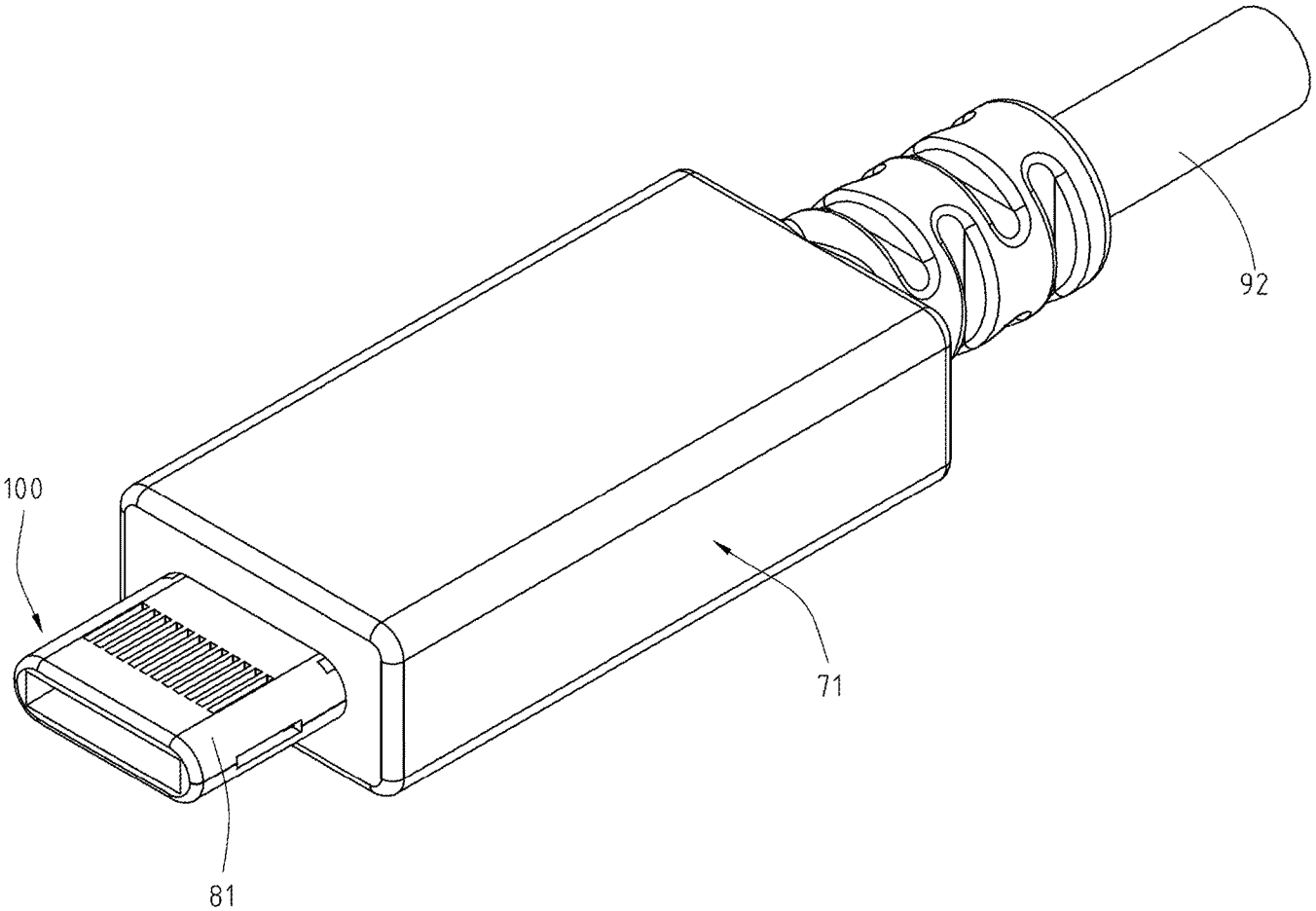
FIG. 1 illustrates a perspective view of an electrical plug connector of a first embodiment of the instant disclosure.

Please refer to FIGS. 1 to 6, illustrating a first embodiment of the instant disclosure. The first embodiment is an exemplary embodiment showing an electrical plug connector 100 assembled with an enveloping shell 71 and a wire 92 to form a connection cable, but embodiments are not limited thereto. In some embodiments, the wire 92 may be omitted and the electrical plug connector 100 together with the enveloping shell 71 form a flash disk or a standing charging dock. In this embodiment, the electrical plug connector 100 can provide a reversible or dual orientation USB Type-C connector interface and pin assignments, i.e., a USB Type-C plug connector. In this embodiment, the electrical plug connector 100 comprises an insulated housing 21 and a plurality of first plug terminals 31 (aligned in a single row).

The appearance of the insulated housing 21 is in compliance with the specification of USB Type-C connector. In this embodiment, the size of the insulated housing 21 is greater than the size of an insulated housing covered by an outer iron shell of a conventional USB Type-C plug connector. Hence, the insulated housing 21 of the first embodiment can be firmly mated with an electrical receptacle connector. In this embodiment, the insulated housing 21 comprises a base portion 210, a tubular portion 21*a*, and a mating room 213. Here, the base portion 210 and the tubular portion 21*a* are injection molded or the like to form the insulated housing 21. The tubular portion 21*a* is extending from one side of the base portion 210. In addition, the tubular portion 21*a* comprises a first portion 211 at the upper portion thereof and a second portion 212 at the lower portion thereof. In other words, the mating room 213 is between the first portion 211 and the second portion 212. The first portion 211 has a first mating surface and a first front lateral surface. The second portion 212 has a second mating surface and a second front lateral surface. The first mating surface corresponds to (i.e., faces) the second mating surface.

Figure 2:
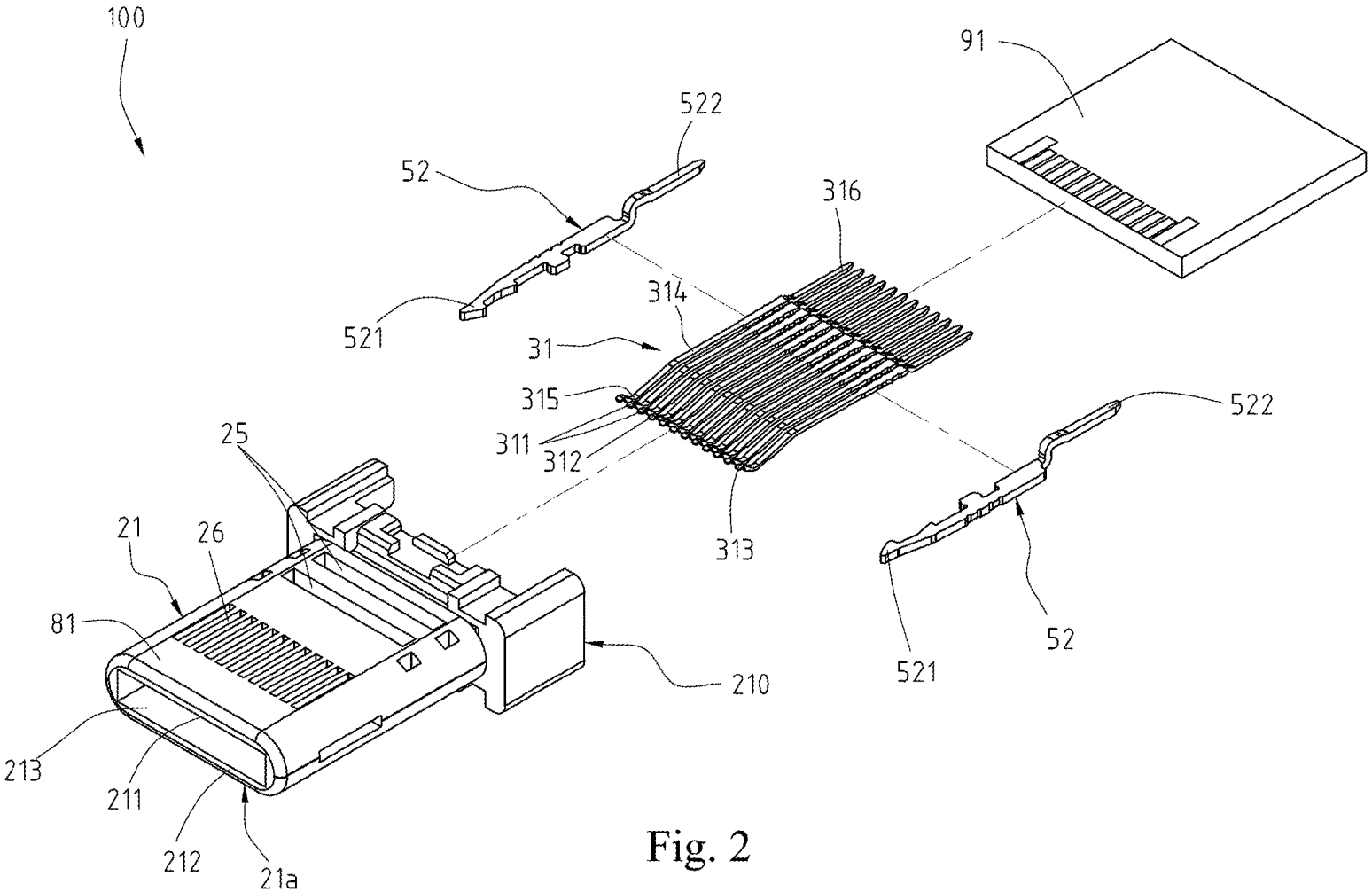
FIG. 2 illustrates an exploded view of the electrical plug connector according to the first embodiment.
Figure 3:
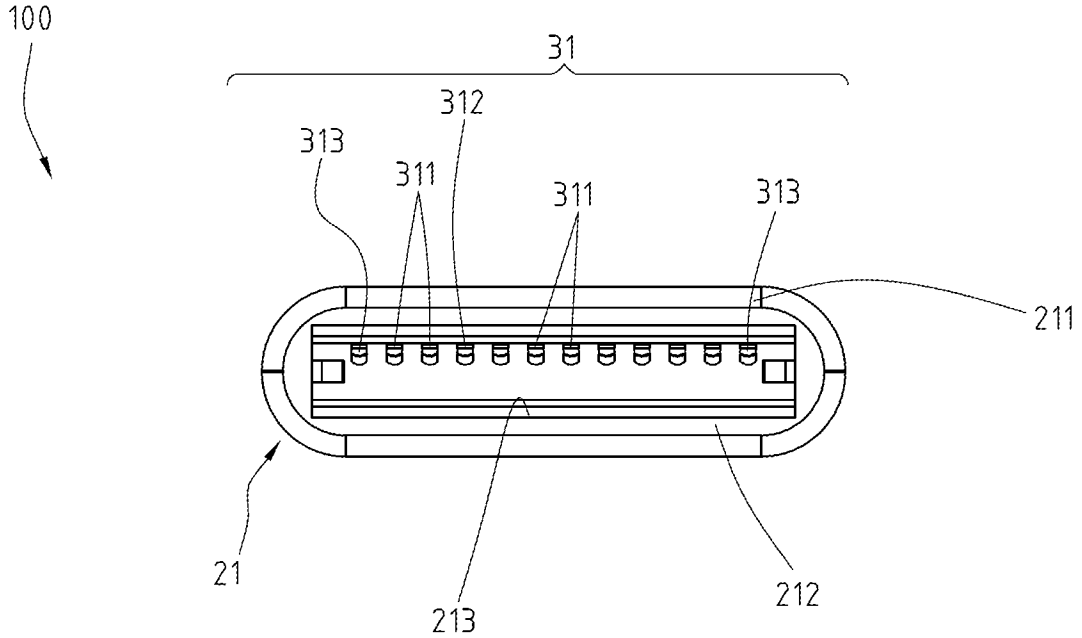
FIG. 3 illustrates a front view of the electrical plug connector according to the first embodiment.

Please refer to FIGS. 1 to 6 and Table 1 below. The first plug terminals 31 are terminals aligned in a row. The first plug terminals 31 comprise a plurality of signal terminals 311, at least one power terminal 312, and at least one ground terminal 313. As shown in FIG. 3 and Table 1, the first plug terminals 31 comprise, from right to left, a ground terminal 313 (Gnd), a first pair of signal terminals 311 (RX2+−, differential signal terminals), a power terminal 312 (Power/VBUS), a detection terminal (CC), a second pair of signal terminals 311 (D+−, differential signal terminals), a secondary bus terminal (SBU1), another power terminal 312 (Power/VBUS), a third pair of signal terminals 311 (RX2+−, differential signal terminals), and another ground terminal 313 (Gnd). However, the pin assignment provided herein is as an illustrative purpose, but not a limitation of the electrical plug connector 100.

TABLE 1

| pin assignment of first plug terminals 31 in a single row (twelve terminals) | | | | | | | | | | | |
|---|---|---|---|---|---|---|---|---|---|---|---|
| A12 | A11 | A10 | A09 | A08 | A07 | A06 | A05 | A4 | A03 | A02 | A1 |
| GND | RX2+ | RX2− | VBUS | SBU1 | D+ | D− | CC | VBUS | RX2+ | RX2− | GND |
| B1 | B02 | B03 | B04 | B05 | B06 | B07 | B08 | B9 | B10 | B11 | B12 |

In the aforementioned embodiment, the electrical plug connector 100 has twelve first plug terminals 31 for USB 2.0 signal transmission, but embodiments are not limited thereto. In some embodiments, as shown in FIGS. 1 to 6 and Table 2, the first pair of signal terminals 311 (RX2+−), the third pair of signal terminals 311 (RX2+−), and the secondary bus terminal (SBU1) are omitted, the seven first plug terminals 31 shown in Table 2 are provided for USB 2.0 signal transmission. In other words, according to embodiments of the instant disclosure, the electrical plug connector 100 comprises first plug terminals 31 aligned in a single row (either as upper plug terminals or as lower plug terminals). In addition, the number of the first plug terminals 31 may be further reduced to seven terminals. In the illustrative embodiment, the first plug terminals 31 are upper plug terminals of the electrical plug connector 100, but embodiments are not limited thereto. The first plug terminals 31 may be the lower plug terminals of the electrical plug connector 100.

TABLE 2

| pin assignment of first plug terminals 31 in a single row (seven terminals) | | | | | | | | | | | |
|---|---|---|---|---|---|---|---|---|---|---|---|
| A12 | A11 | A10 | A09 | A08 | A07 | A06 | A05 | A4 | A03 | A02 | A1 |
| GND | | | VBUS | | D+ | D− | CC | VBUS | | | GND |
| B1 | B02 | B03 | B04 | B05 | B06 | B07 | B08 | B9 | B10 | B11 | B12 |

Please refer to FIGS. 1 to 6. Each of the first plug terminals 31 comprises a flexible contact portion 315, a body portion 314, and a tail portion 316. For each of the first plug terminals 31, the body portion 314 is held in the first portion 211, the flexible contact portion 315 is extending forward from the body portion 314 in the rear-to-front direction and partly exposed upon the first mating surface of the first portion 211, and the tail portion 316 is extending backward from the body portion 314 in the front-to-rear direction and protruded from the insulated housing 21. The first plug terminals 31 partly project into the mating room 213 and are provided for transmitting first signals (i.e., USB 2.0 signals.). The tail portions 316 of the first plug terminals 31 are extending from the rear of the insulated housing 21.

The first plug terminals 31 and the flexible contact portions 315 are formed by stamping a metallic sheet. Referring to FIGS. 1 to 6, because the first plug terminals 31 are integrated with each other via the extending portions 32, the structural strength of the flexible contact portions 315 can be improved. Hence, the flexible contact portions 315 would not be bent downward by the gravity force. In other words, the flexible contact portions 315 are integrated with each other via the extending portions 32, and the first plug terminals 31 are integrated to form a unitary piece. Therefore, before the first plug terminals 31 are formed with the insulated housing 21, the flexible contact portions 315 would not be bent downward by the gravity force because of the improved structural strength of the flexible contact portions 315. In addition, because the first plug terminals 31 are connected with each other via the extending portions 32, the flexible contact portions 315 can be positioned properly during the insert-molding procedure.

Figure 4:
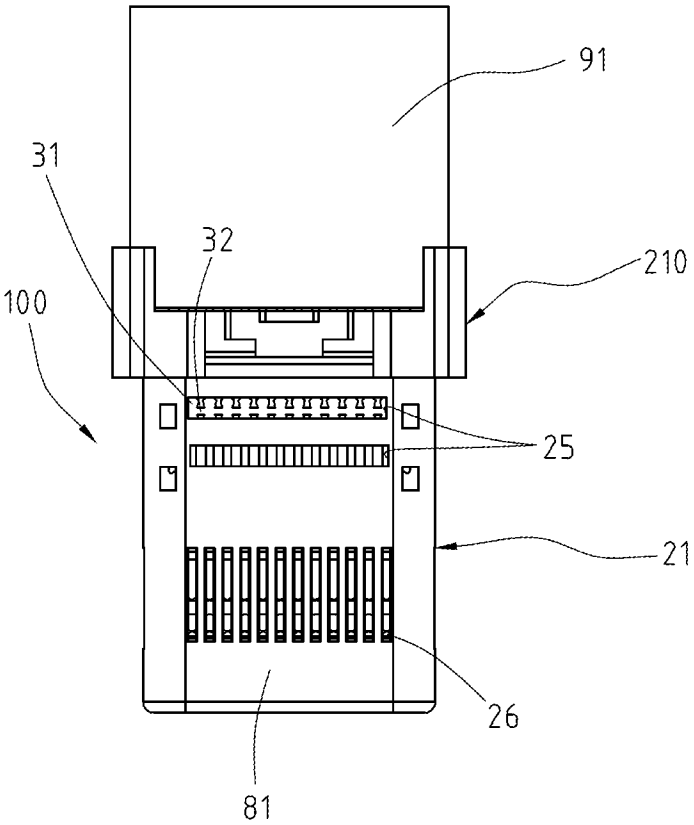
FIG. 4 illustrates a top view of the electrical plug connector with the extending portions according to the first embodiment.
Figure 5:
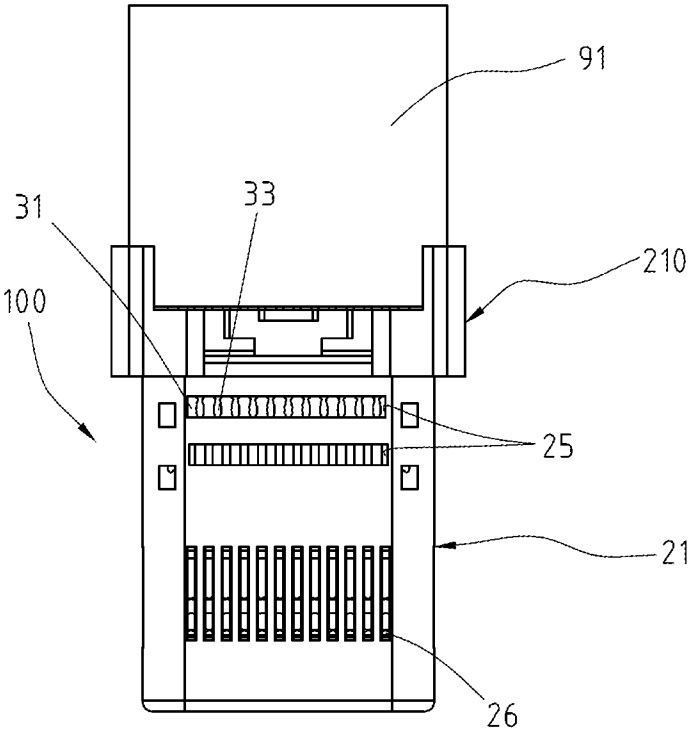
FIG. 5 illustrates a top view of the electrical plug connector without the extending portions according to the first embodiment.

The insulated housing 21 is assembled with the first plug terminals 31 by insert-molded techniques or the like. As shown in FIG. 4, the first plug terminals 31 are formed as a unitary piece via the extending portions 32 extending between the first plug terminals 31. The insulated housing 21 comprises a first groove 25 on the rear of the first portion 211. The extending portions 32 correspond to the first groove 25. The formation of the first groove 25 is described as below. In the insert molding procedure, the insulated housing 21 is received in a mold having a plurality of processing fixtures. After the insulated housing 21 is molded, the rear of the first portion 211 forms a first groove 25. In addition, the first plug terminals 31 comprise a plurality of cut portions 33 formed with the body portions 314 and correspond to the first groove 25. Because the cut portions 33 correspond to the first groove 25, pressing fixtures can be inserted into the first groove 25 to cut the cut portions 33 (i.e., to break the extending portions 32). Therefore, as shown in FIG. 5, the first plug terminals 31 can be separated with each other by breaking the extending portions 32. Accordingly, the first plug terminals 31 can be manufactured in the insulated housing 21 conveniently.

Figure 6:
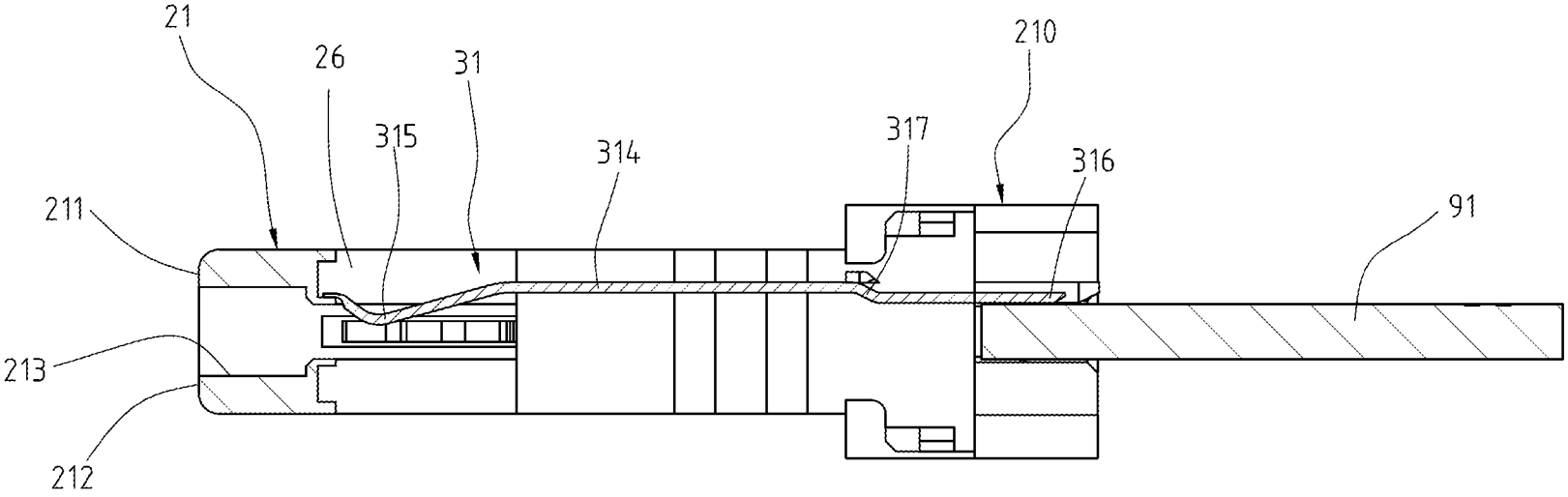
FIG. 6 illustrates a lateral sectional view of the electrical plug connector according to the first embodiment.

The insulated housing 21 comprises a plurality of second grooves 26, as shown in FIG. 6. The second grooves 26 may be directly formed on the first portion 211 after the insulated housing 21 is insert-molded. The second grooves 26 respectively correspond to the flexible contact portions 315 of the first plug terminals 31. The second grooves 26 are adjacent to the opening of the mating room 213. In other words, the second grooves 26 are positioned corresponding to the first plug terminals 31 to provide the flexible contact portions 315 with a swinging room. Specifically, when the flexible contact portions 315 are in contact with an electrical receptacle connector, the flexible contact portions 315 are bent in the second grooves 26.

Figure 8:
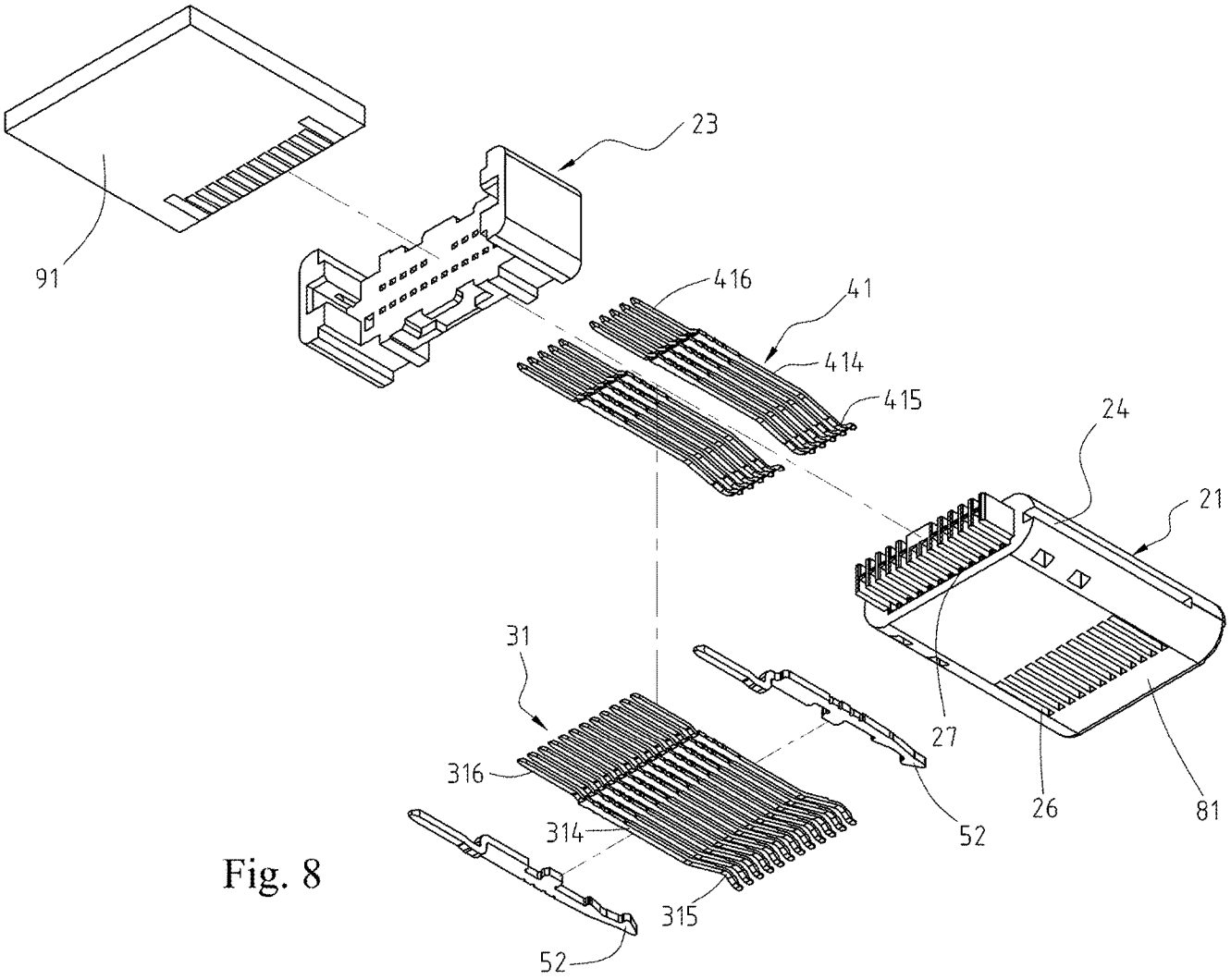
FIG. 8 illustrates an exploded view (2) of the electrical plug connector with two rows of plug terminals.

In the foregoing embodiment, the insulated housing 21 is integrated with the first plug terminals 31 by insert-molding techniques, but embodiments are not limited thereto. In some embodiments, the first plug terminals 31 may be integrated with the insulated housing 21 by assembling means, as shown in FIG. 8. In this embodiment, the rear of the insulated housing 21 comprises a plurality of through grooves 27 defined therethrough and a plurality of partition blocks between the through grooves 27. The first plug terminals 31 are assembled into the through grooves 27 from the rear of the insulated housing 21, so that the tail portions 316 of the first plug terminals 31 are protruded out of the through grooves 27. Next, a rear block 23 is fitted over the tail portions 316 of the first plug terminals 31. In other words, in such embodiment, the rear block 23 and the insulated housing 21 are separated pieces, and the rear block 23 can be fixed at the rear of the insulated housing 21 by assembling. However, in some embodiments, the rear block 23 and the insulated housing 21 can be integrated as a unitary piece, as shown in FIG. 2. In addition, in this embodiment, the first plug terminals 31 are at the first mating surface of the first portion 211, but embodiments are not limited thereto. In some embodiments, the first plug terminals 31 are at the second mating surface of the second portion 212.

In the foregoing embodiment, the first plug terminals 31 are aligned into a single row. The number of the first plug terminals 31 may be reduced according to user requirements. The first plug terminals 31 can perform power and/or signal transmission. In some embodiments, please refer to FIGS. 7 to 10 and Table 3, the electrical plug connector 100 further comprises a plurality of second plug terminals 41. The second plug terminals 41 and the first plug terminals 31 form a two-row terminal configuration. The second plug terminals 41 comprise a plurality of signal terminals 411, at least one power terminal 412, and at least one power terminal 413. As shown in FIG. 10 and Table 3, the second plug terminals 41 comprise, from left to right, a ground terminal 413 (Gnd), a first pair of signal terminals 411 (TX2+−, differential signal terminals), a power terminal 412 (Power/VBUS), a Vcon terminal (VCON), a second pair of signal terminals 411 (D+−, differential signal terminals), a secondary bus terminal (SBU2), another power terminal 412 (Power/VBUS), a third pair of signal terminals 411 (TX2+−, differential signal terminals), and another ground terminal 413 (Gnd). However, the pin assignment provided herein is as an illustrative purpose, but not a limitation of the electrical plug connector 100. In this embodiment, the electrical plug connector 100 have twelve second plug terminals 41 for USB 2.0 signal transmission, but embodiments are not limited thereto.

TABLE 3

| pin assignment of plug terminals 31, 41 in two rows (each having twelve terminals) | | | | | | | | | | | |
|---|---|---|---|---|---|---|---|---|---|---|---|
| A12 | A11 | A10 | A09 | A08 | A07 | A06 | A05 | A4 | A03 | A02 | A1 |
| GND | RX2+ | RX2− | VBUS | SBU1 | D+ | D− | CC | VBUS | RX2+ | RX2− | GND |
| GND | TX2+ | TX2− | VBUS | VCON | D− | D+ | SBU2 | VBUS | TX2+ | TX2− | GND |
| B1 | B02 | B03 | B04 | B05 | B06 | B07 | B08 | B9 | B10 | B11 | B12 |

In some embodiments, some of the terminals may be omitted, as shown in Table 4.

TABLE 4

| pin assignment of plug terminals 31, 41 in two rows of a reduced terminal configuration | | | | | | | | | | | |
|---|---|---|---|---|---|---|---|---|---|---|---|
| A12 | A11 | A10 | A09 | A08 | A07 | A06 | A05 | A4 | A03 | A02 | A1 |
| GND | | | VBUS | | D+ | D− | CC | VBUS | | | GND |
| GND | | | VBUS | VCON | | | | VBUS | | | GND |
| B1 | B02 | B03 | B04 | B05 | B06 | B07 | B08 | B9 | B10 | B11 | B12 |

Please refer to FIGS. 7 to 10. Each of the second plug terminals 41 comprises a flexible contact portion 415, a body portion 414, and a tail portion 416. For each of the second plug terminals 41, the body portion 414 is held in the second portion 212, the flexible contact portion 415 is extending forward from the body portion 414 in the rear-to-front direction and partly exposed upon the second mating surface of the second portion 212, and the tail portion 416 is extending backward from the body portion 414 in the front-to-rear direction and protruded from the insulated housing 21. The second plug terminals 41 partly project into the mating room 213 and are provided for transmitting second signals (i.e., USB 2.0 signals.). The tail portions 416 of the second plug terminals 41 are extending from the rear of the insulated housing 21. In addition, the tail portions 416 are aligned horizontally. The tail portions 316 may be aligned horizontally, and the tail portions 316, 416 are aligned in two rows, but embodiments are not limited thereto. In some embodiments, the tail portions 316 of the first plug terminals 31 may be bent to make the tail portions 316 and the tail portions 416 aligned into the same line as a single row configuration.

Figure 9:
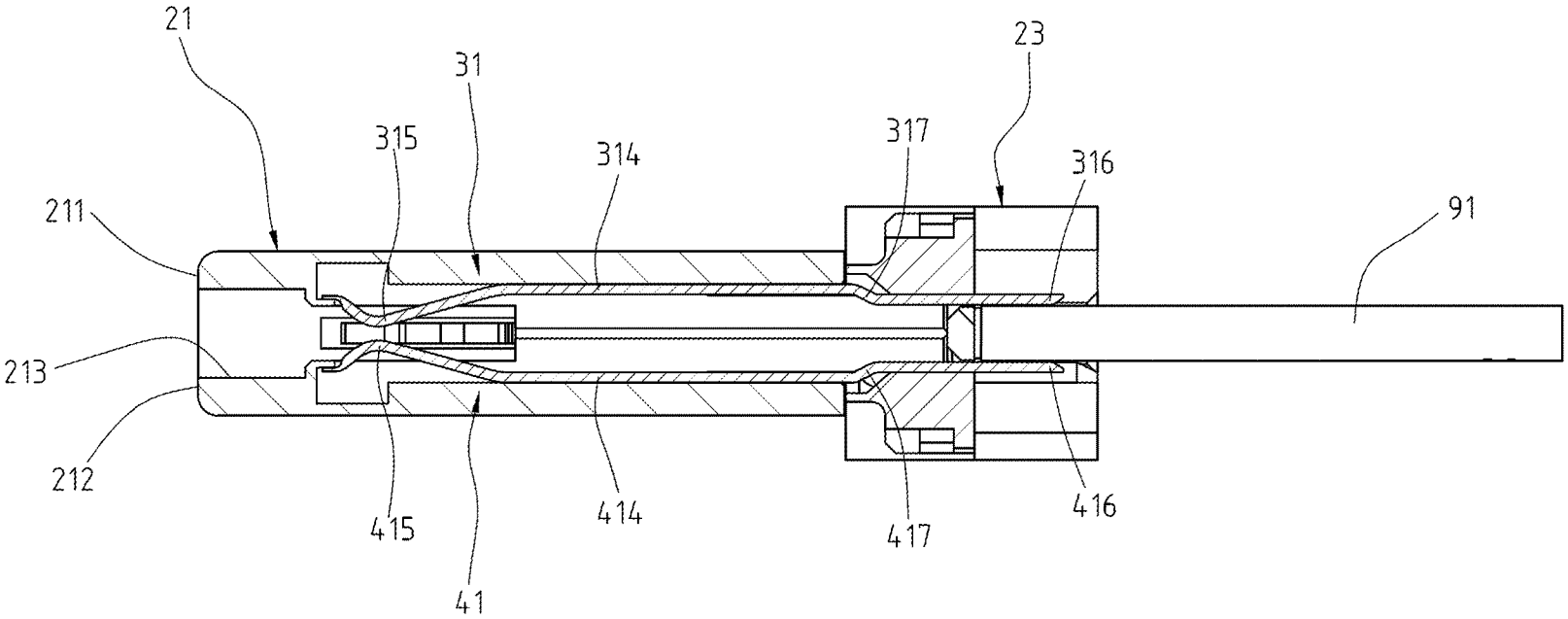
FIG. 9 illustrates a lateral sectional view of the electrical plug connector with two rows of plug terminals.
Figure 10:
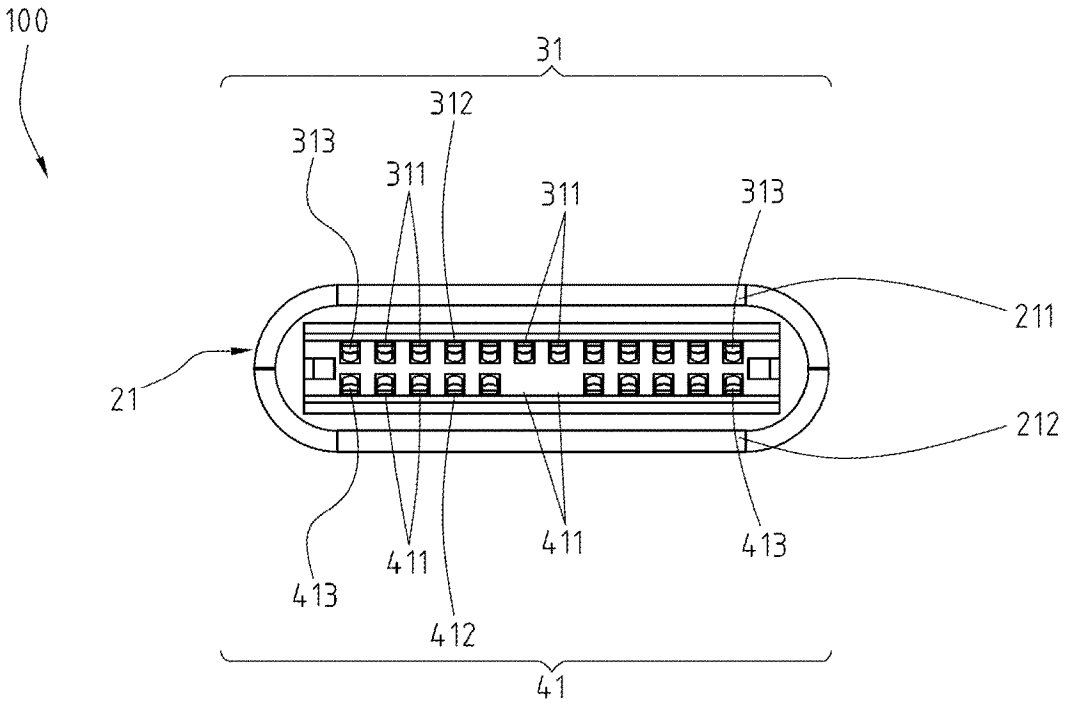
FIG. 10 illustrates a front view of the electrical plug connector with two rows of plug terminals.
Figure 11:
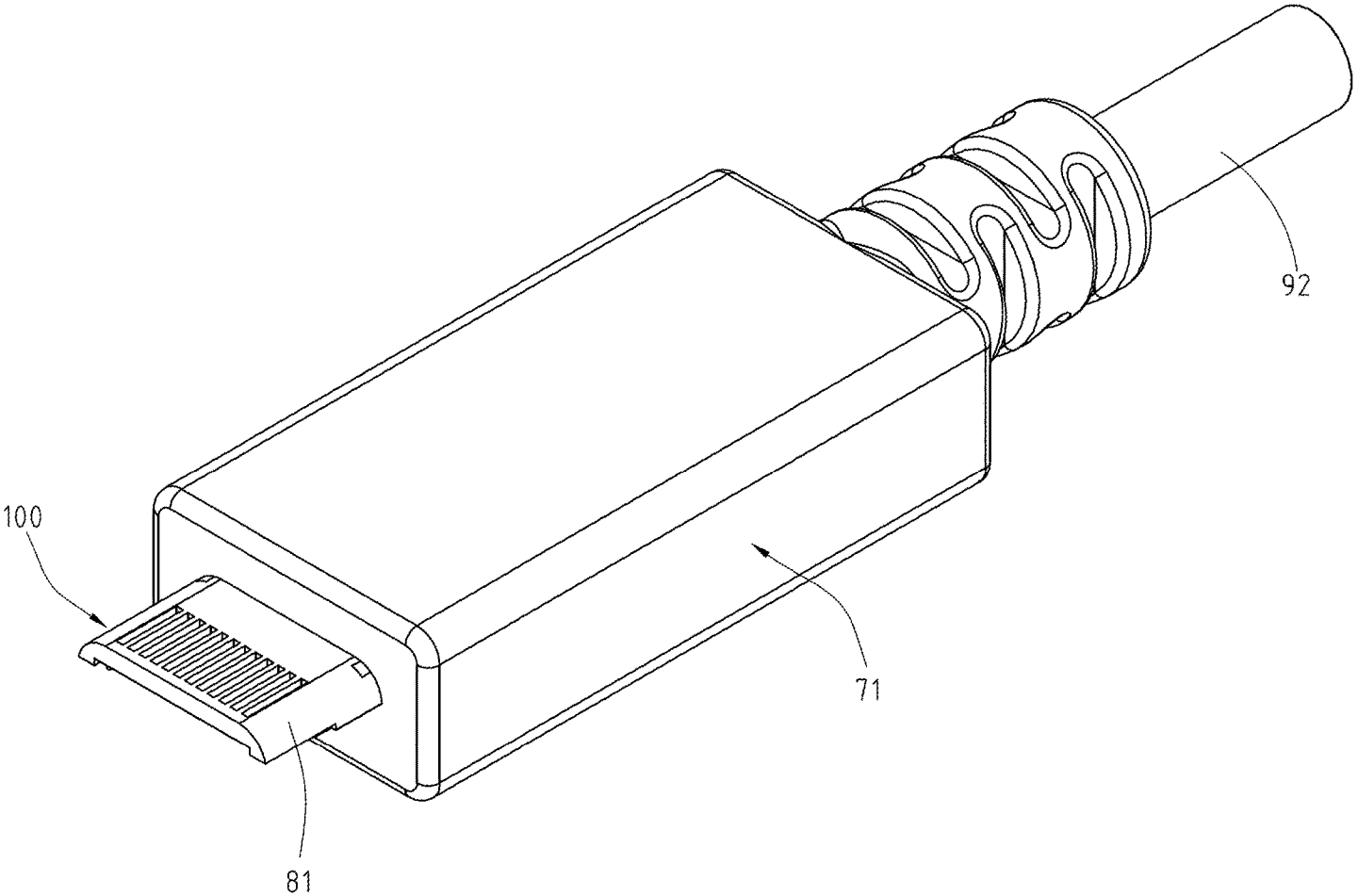
FIG. 11 illustrates a perspective view (1) of an electrical plug connector of a second embodiment of the instant disclosure.

Please refer to FIGS. 1, 8 and 9. In some embodiments, the electrical plug connector 100 is further connected to a wire 92. Specifically, when the tail portions 316 and the tail portions 416 are exposed from the through grooves 27 of the rear block 23, sub wires of the wire 92 are soldered with the tail portions 316, 416. In addition, the wire 92 may be a coaxial cable. Moreover, the wire 92 may be manufactured by hot bar, hot air drying, or ultrahigh frequency soldering.

Figure 7:
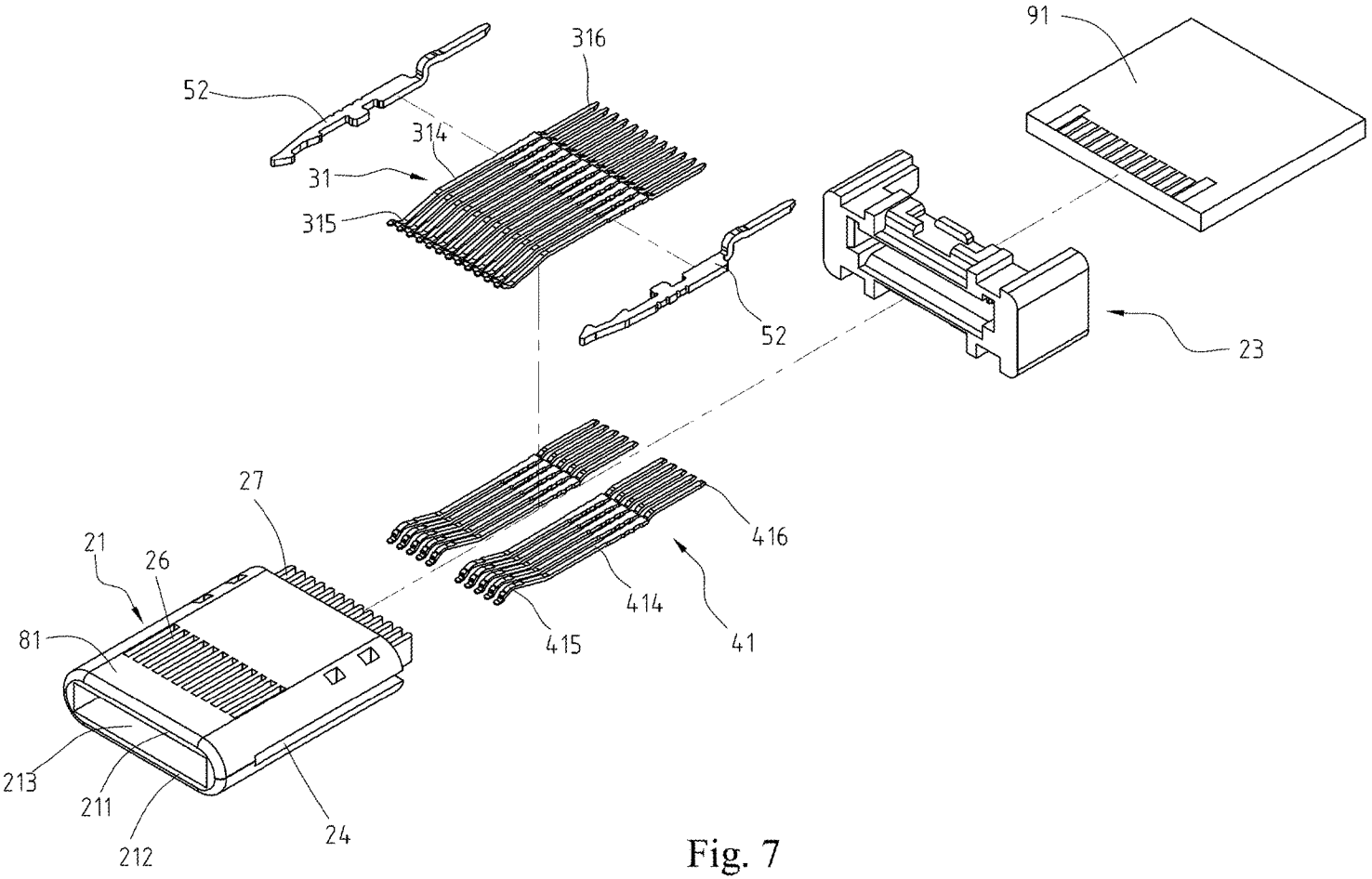
FIG. 7 illustrates an exploded view (1) of the electrical plug connector with two rows of plug terminals.

Please refer to FIGS. 2 and 3. The electrical plug connector 100 further comprises a plurality of engaging portions 52 respectively at two sides of the insulated housing 21. The insulated housing 21 and the engaging portions 52 may be formed with each other by insert-molded technique or the like. Alternatively, the engaging portions 52 may be assembled with the insulated housing 21. In the latter configuration, the insulated housing 21 has through slots 24 at two sides thereof for positioning the engaging portions 52, respectively, as shown in FIGS. 7 and 8. Each of the engaging portions 52 comprises a hook portion 521 and a protruded contact portion 522. The rears of the hook portions 521 are in contact with contacts of a circuit board 91. The protruded contact portion 522 is extending from the front of the hook portion 521 and inserted into the side portion of the mating room 213. When the electrical plug connector 100 is mated with an electrical receptacle connector, buckling pieces at two sides of the electrical receptacle connector are in contact with the protruded contact portions 522. Therefore, the electrical plug connector 100 is positioned with the electrical receptacle connector by the engaging portions 52. Moreover, because the rears of the hook portions 521 are in contact with the contacts of the circuit board 91, noises can be grounded and conducted when the electrical plug connector 100 is mated with an electrical receptacle connector.

In the foregoing embodiment, the first plug terminals 31 and the second plug terminals 41 are aligned into two rows; however, it is understood that the number of the plug terminals 31, 41 may be reduced according to user requirements. Alternatively, the plug terminals 31, 41 may be simplified to a single row, according to user requirements. The plug terminals 31, 41 can perform power and/or signal transmission. In some embodiments, an electrical receptacle connector to be mated with the electrical plug connector 100 has a plurality of upper-row receptacle terminals and a plurality of lower-row receptacle terminals (i.e., a Type-C receptacle connector), the electrical plug connector 100 may be devoid of the first plug terminals 31 or the second plug terminals 41 while still mated with the electrical receptacle connector in dual mating directions. Specifically, when the first plug terminals 31 are omitted, the electrical plug connector 100 is mated with the electrical receptacle connector in either two orientations; that is, the second plug terminals 41 may be in contact with the upper-row receptacle terminals or the lower-row receptacle terminals of the electrical receptacle connector. Conversely, when the second plug terminals 41 are omitted, the electrical plug connector 100 can also be mated with the electrical receptacle connector in either two orientations; that is, the first plug terminals 31 may be in contact with the upper-row receptacle terminals or the lower-row receptacle terminals of the electrical receptacle connector. Therefore, the inserting orientation of the electrical plug connector 100 is not limited by the electrical receptacle connector.

Please refer to FIGS. 7 to 10. In this embodiment, the first plug terminals 31 and the second plug terminals 41 are respectively disposed at the first mating surface of the first portion 211 and the second mating surface of the second portion 212. Additionally, pin-assignments of the first plug terminals 31 and the second plug terminals 41 are point-symmetrical with a central point of the mating room 213 as the symmetrical center. In other words, pin-assignments of the first plug terminals 31 and the second plug terminals 41 have 180 degree symmetrical design with respect to the central point of the mating room 213 as the symmetrical center. The dual or double orientation design enables the electrical plug connector 100 to be inserted into an electrical receptacle connector in either of two intuitive orientations, i.e., in either upside-up or upside-down directions. Here, point-symmetry means that after the first plug terminals 31 (or the second plug terminals 41), are rotated by 180 degrees with the symmetrical center as the rotating center, the first plug terminals 31 and the second plug terminals 41 are overlapped. That is, the rotated first plug terminals 31 are arranged at the position of the original second plug terminals 41, and the rotated second plug terminals 41 are arranged at the position of the original first plug terminals 31. In other words, the first plug terminals 31 and the second plug terminals 41 are arranged upside down, and the pin assignments of the first plug terminals 31 are left-right reversal with respect to that of the second plug terminals 41. The electrical plug connector 100 is inserted into an electrical receptacle connector with a first orientation where the first mating surface is facing down, for transmitting first signals. Conversely, the electrical plug connector 100 is inserted into the electrical receptacle connector with a second orientation where the first mating surface is facing up, for transmitting second signals. Furthermore, the specification for transmitting the first signals is conformed to the specification for transmitting the second signals. Note that, the inserting orientation of the electrical plug connector 100 is not limited by the electrical receptacle connector.

In this embodiment, the tail portions 316, 416 are protruded from the rear of the insulated housing 21 and aligned separately. The tail portions 316 of the first plug terminals 31 and the tail portions 416 of the second plug terminals 41 are respectively aligned into two parallel rows. In this embodiment, each of the first plug terminals 31 comprises a first bent portion 317 extending from the rear of the body portion 314 toward the tail portion 316. In other words, the body portion 314 and the tail portion 316 are not aligned in the same line. Hence, the distance between the tail portions 316 of the first plug terminals 31 and the tail portions 416 of the second plug terminals 41 can be adjusted by the first bent portions 317 of the first plug terminals 31. In addition, in some embodiments, each of the second plug terminals 41 comprises a second bent portion 417 extending from the rear of the body portion 414 toward the tail portion 416. In other words, the body portion 414 and the tail portion 416 are not aligned in the same line. Hence, the distance between the tail portions 316 of the first plug terminals 31 and the tail portions 416 of the second plug terminals 41 can be adjusted by the second bent portions 417 of the second plug terminals 41. Accordingly, the tail portions 316, 416 may be soldered with wires 92; alternatively, the tail portions 316, 416 may be soldered with contacts of a circuit board 91. Here, the circuit board 91 has several contacts respectively at two opposite surfaces thereof. The contacts at one of the two surfaces of the circuit board 91 are in contact with the tail portions 316 of the first plug terminals 31, while the contacts at the other surface of the circuit board 91 are in contact with the tail portions 416 of the second plug terminals 41. Because of the multi-bent configuration of the first bent portions 317 and the second bent portions 417, the distance between the tail portions 316 of the first plug terminals 31 and the tail portions 416 of the second plug terminals 41 can be adjusted, while the high frequency character of the plug terminals 31, 41 can be retained.

Please refer to FIG. 10. In this embodiment, the positions of the first plug terminals 31 correspond to the position of the second plug terminals 41. In other words, the flexible contact portions 315 of the first plug terminals 31 are aligned with the flexible contact portions 415 of the second plug terminals 41. Moreover, the tail portions 316 of the first plug terminals 31 may be also aligned with the tail portions 416 of the second plug terminals 41, but embodiments are not limited thereto. In some embodiment, the first plug terminals 31 may be aligned by an offset with respect to the second plug terminals 41. In other words, the flexible contact portions 315 of the first plug terminals 31 are aligned by an offset with respect to the flexible contact portions 415 of the second plug terminals 41. Moreover, the tail portions 316 of the first plug terminals 31 may be also aligned by an offset with respect to the tail portions 416 of the second plug terminals 41. Accordingly, the crosstalk between the first plug terminals 31 and the second plug terminals 41 can be reduced during signal transmission because of the offset alignment of the plug terminals 31, 41. It is understood that, when the plug terminals 31, 41 of the electrical plug connector 100 have the offset alignment, receptacle terminals of an electrical receptacle connector to be mated with the electrical plug connector 100 would also have the offset alignment. Hence, the receptacle terminals of the electrical receptacle connector can be in contact with the plug terminals 31, 41 of the electrical plug connector 100 for power and/or signal transmission.

Please refer to FIGS. 11 to 16, which illustrate an electrical plug connector 100 according to a second embodiment of the instant disclosure. In the first embodiment, the front of the insulated housing 21 forms the tubular portion 21*a*; i.e., the first portion 211 and the second portion 212 are respectively at the upper portion and the lower portion of the tubular portion 21*a*, and the mating room 213 is between the first portion 211 and the second portion 212. In the second embodiment, the insulated housing 21 comprises a semi-tubular portion 22, and the semi-tubular portion 22 comprises a first portion 211 or a second portion 212 of the first embodiment. In other words, the semi-tubular portion 22 is a half portion of the tubular portion 21*a* (cut along the axis of the tubular portion 21*a*) of the first embodiment, and the first portion 211 (or the second portion 212) is at the upper portion (or the lower portion) of the semi-tubular portion 22.

Figure 17:
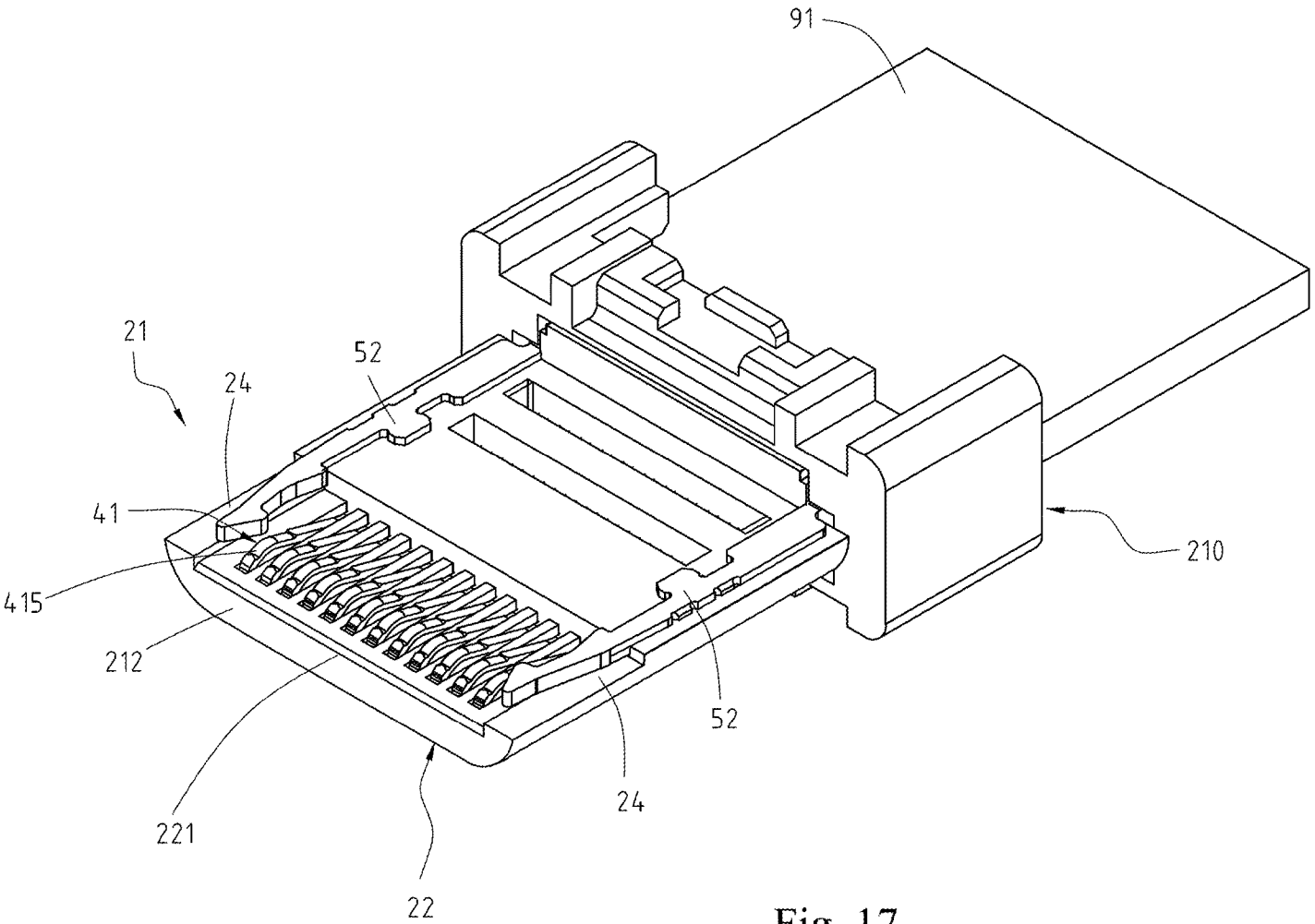
FIG. 17 illustrates a perspective view (5) of the electrical plug connector according to the second embodiment.

Please refer to FIG. 17. In this embodiment, the semi-tubular portion 22 comprises a portion (may be the first portion 211 shown in FIG. 12 or the second portion 212 shown in FIG. 15), a front stopping portion 221 at a front lateral surface of the portion, and a plurality of side blocks 222 extending outward from two sides of the portion (taking the first portion 211 as an example, the side blocks 222 are extending downward from two sides of the first portion 211; taking the second portion 212 as an example, the side blocks 222 are extending upward from two sides of the second portion 212). As shown in FIG. 17, the cross-section of the second portion 212 is approximately formed as a U-shaped structure. In addition, when the electrical plug connector 100 is mated with an electrical receptacle connector, the front stopping portion 221 is leaned against an abutting surface of the electrical receptacle connector, and the side blocks 222 are inserted into and fastened with the electrical receptacle connector.

Figure 14:
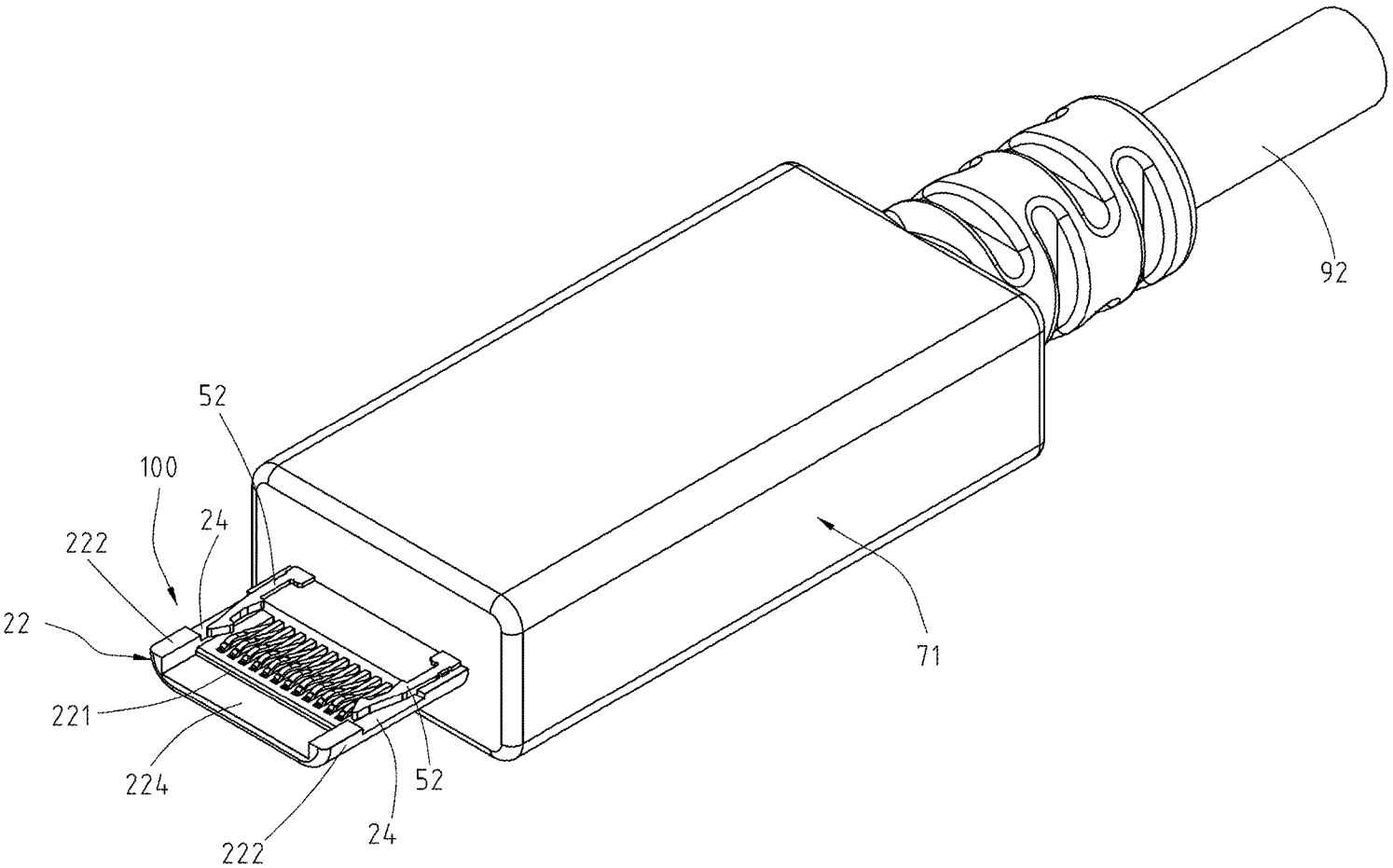
FIG. 14 illustrates a perspective view (2) of the electrical plug connector according to the second embodiment.
Figure 15:
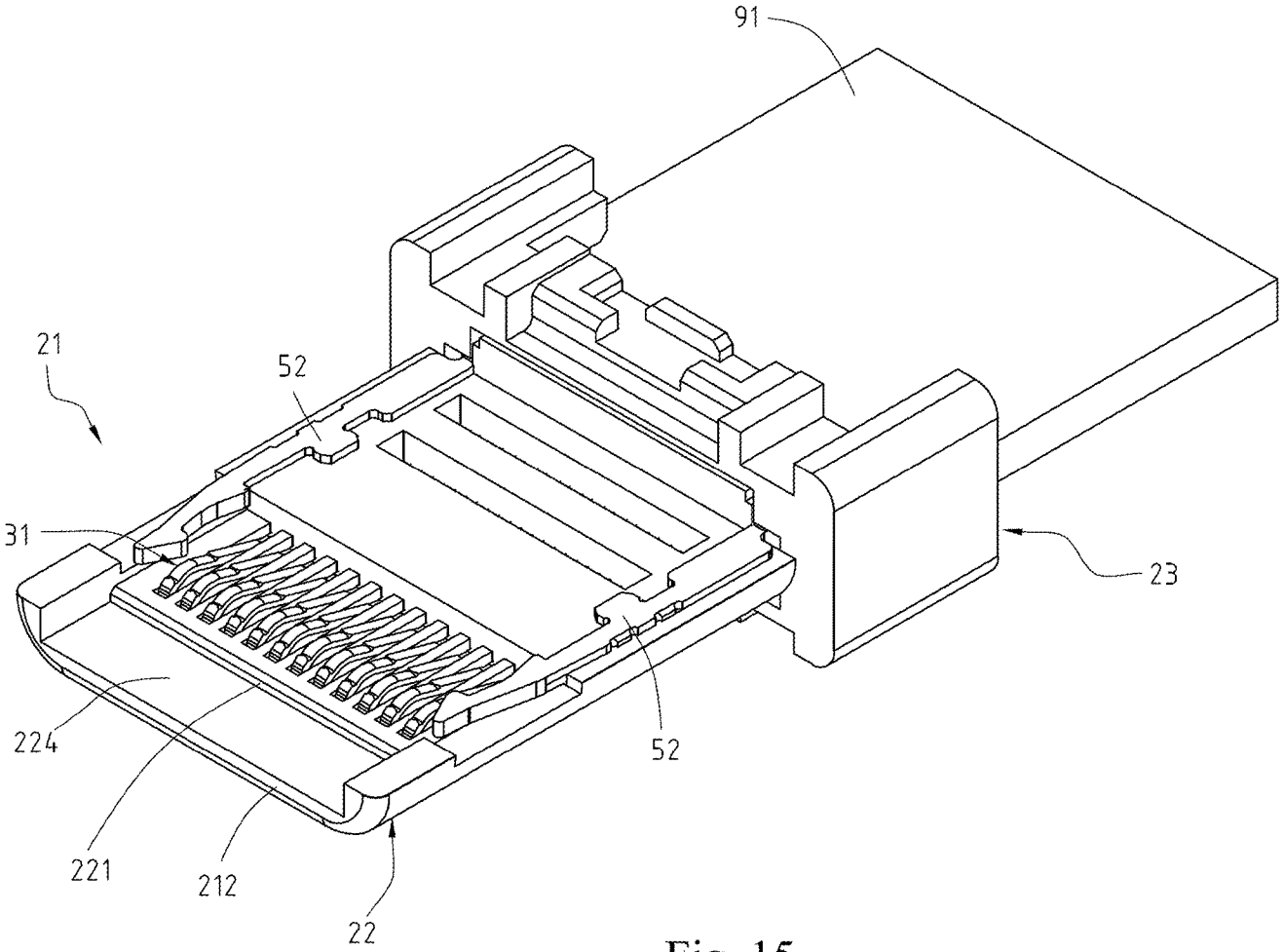
FIG. 15 illustrates a perspective view (3) of the electrical plug connector according to the second embodiment.

In this embodiment, the length of the second portion 212 shown in FIG. 17 is less than the length of the second portion 212 shown in FIG. 14. In other words, the second portion 212 shown in FIG. 17 is devoid of the reserved portion 224 of the second portion 212 shown in FIG. 14 (i.e., the block structure located between the flexible contact portions 415 of the second plug terminals 41 and the front lateral portion of the second portion 212). In other words, the distance between the end portion of the front lateral portion of the second portion 212 and the flexible contact portions 415 of the second plug terminals 41 shown in FIG. 17 is shorter than the distance between the end portion of the front lateral portion of the second portion 212 and the flexible contact portions 415 of the second plug terminals 41 shown in FIG. 14. In addition, because of the reduced length of the second portion 212, the insulated housing 21 shown in FIG. 17 takes less cost as compared to the insulated housing 21 of the first embodiment and the insulated housing 21 shown in FIG. 14.

Figure 16:
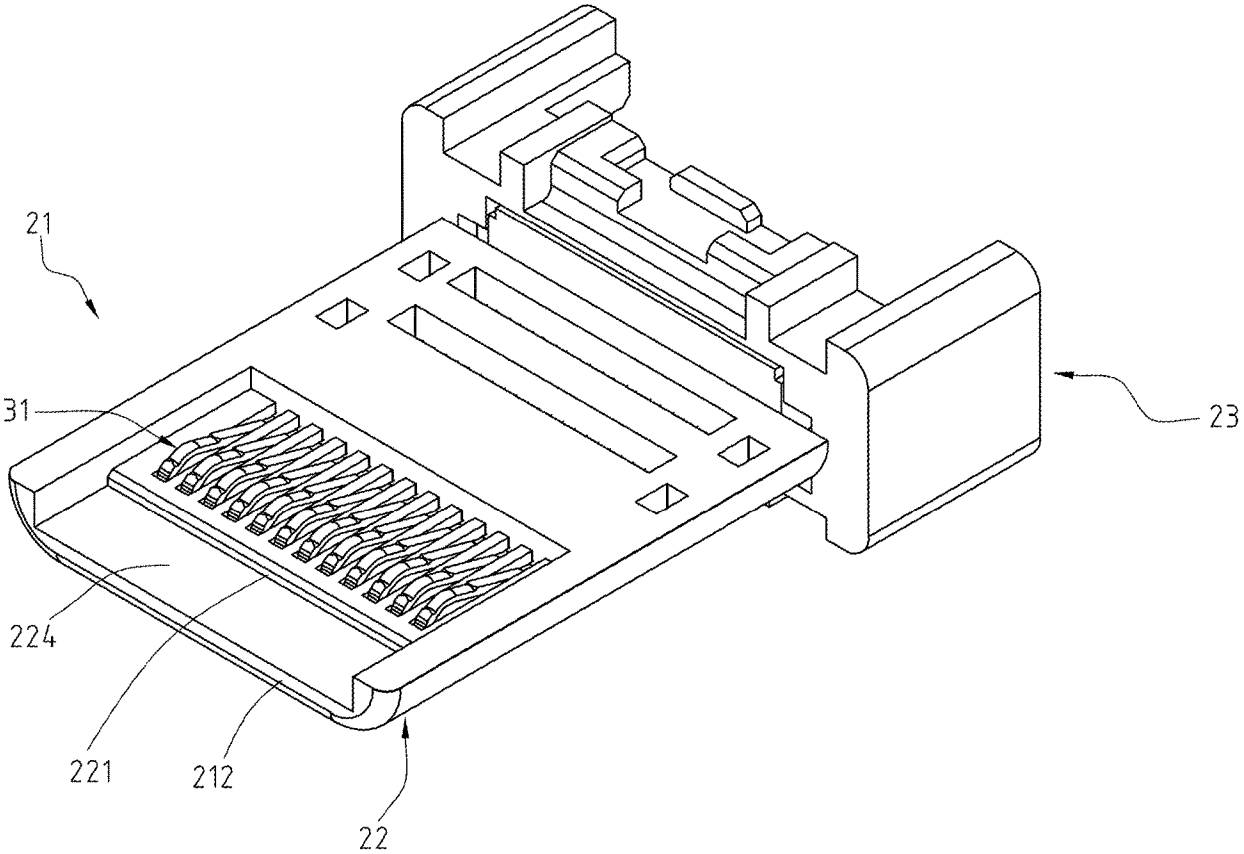
FIG. 16 illustrates a perspective view (4) of the electrical plug connector according to the second embodiment.

In addition, in this embodiment, the electrical plug connector 100 may further comprise a plurality of engaging portions 52 (as shown in FIGS. 12, 14, 15, and 17) or may not (as shown in FIG. 16). Moreover, the engaging portions 52 and the insulated housing 21 may be assembled with each other, or the engaging portions 52 are inserted-molded with the insulated housing 21 as described in the first embodiment. In detail, the engaging portions 52 may be inserted-molded with the semi-tubular portion 22, or the engaging portions 52 may be assembled with the semi-tubular portion 22. In the assembly, the semi-tubular portion 22 has through grooves 24 at two sides thereof. In other words, the through grooves 24 are formed on the side blocks 222 at two sides of the second portion 212, and the engaging portions 52 are held in the through grooves 24. In addition, once the electrical plug connector 100 is devoid of the engaging portions 52, the two sides of the semi-tubular portion 22 may be flat, as shown in FIG. 16.

In this embodiment, the insulated housing 21 of the electrical plug connector 100 comprises the semi-tubular portion 22, and the structure of the semi-tubular portion 22 is conformed to the specification of an USB Type-C connection interface and can be mated with an electrical receptacle connector (Type-C receptacle connector). In this embodiment, the insulated housing 21 comprises a plurality of plug terminals (which may be the first plug terminals 31 or the second plug terminals 41) aligned in a single row. In this embodiment, the plug terminals 31 or 41 may be formed with the insulated housing 21 by the similar manner as described in the first embodiment, i.e., the plug terminals 31 or 41 may be insert-molded in the insulated housing 21, or the plug terminals 31 or 41 may be assembled with the insulated housing 21.

In this embodiment, the semi-tubular portion 22 is devoid of the mating room 213 shown in the first embodiment. In addition, the plug terminals 31 or 41 are aligned into a single row to correspond to the semi-tubular portion 22. When the plug terminals are the first plug terminals 31, the flexible contact portions 315 of the first plug terminals 31 are extending toward the first mating surface of the first portion 211; while when the plug terminals are the second plug terminals 41, the flexible contact portions 415 of the second plug terminals 41 are extending toward the second mating surface of the second portion 212. In addition, the plug terminals 31 or 41 comprise a plurality of signal terminals 311 or 411, at least one power terminal 312 or 412, and at least one ground terminal 313 or 413. The plug terminals 31 or 41 are held in the insulated housing 21 and at the surface of the portion (at the first mating surface of the first portion 211 or at the second mating surface of the second portion 212).

Moreover, each of the plug terminals 31, 41 comprises a flexible contact portion 315, 415, a body portion 314, 414, and a tail portion 316, 416. The body portion 314, 414 is held in the portion (the first portion 211 or the second portion 212), the flexible contact portion 315, 415 is extending forward from the body portion 314, 414 in the rear-to-front direction and partly exposed upon the first mating surface of the first portion 211 or second mating surface of the second portion 212, and the tail portion 316, 416 is extending backward from the body portion 314, 414 in the front-to-rear direction and protruded from the insulated housing 21.

Figure 12:
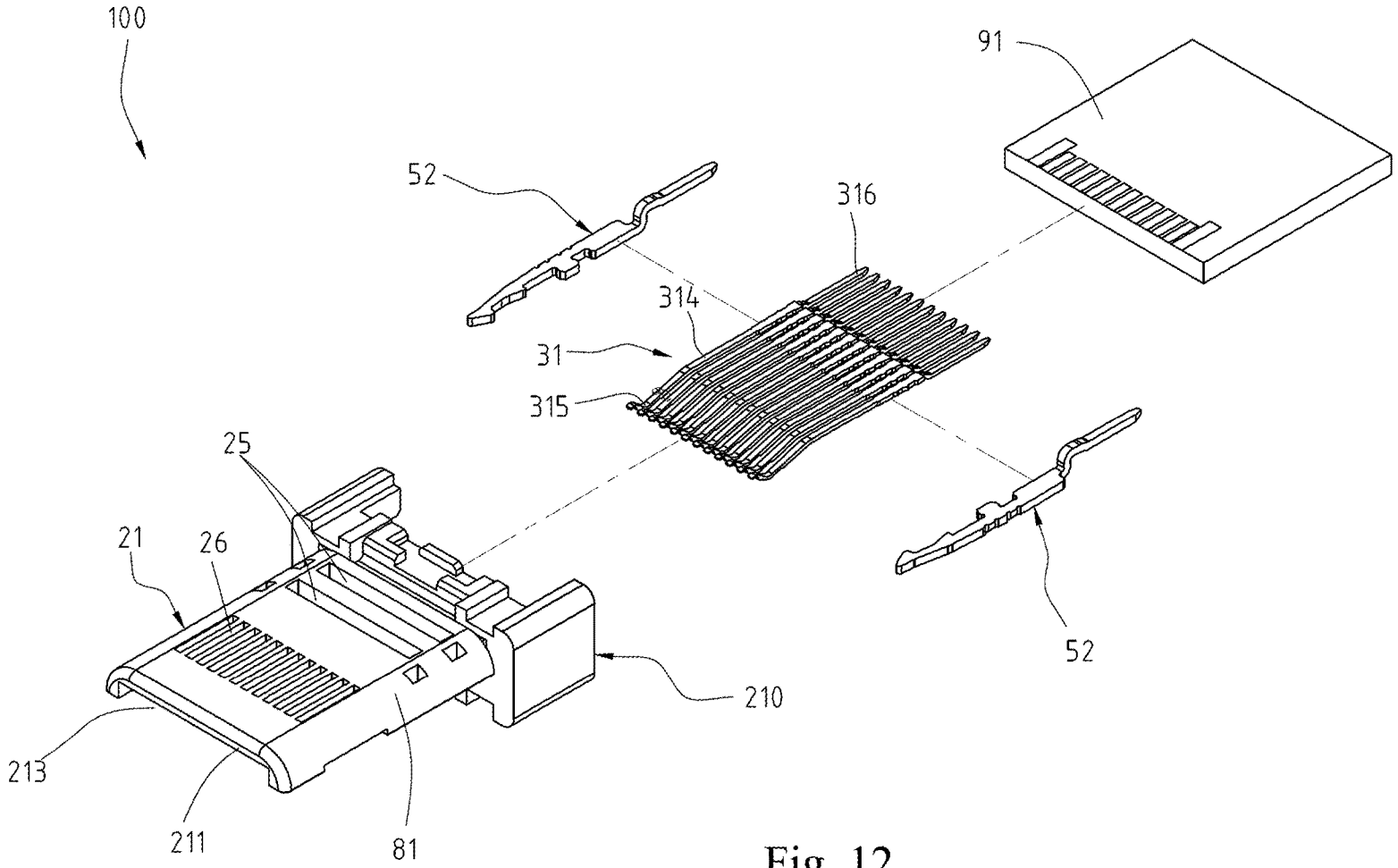
FIG. 12 illustrates an exploded view of the electrical plug connector according to the second embodiment.
Figure 13:
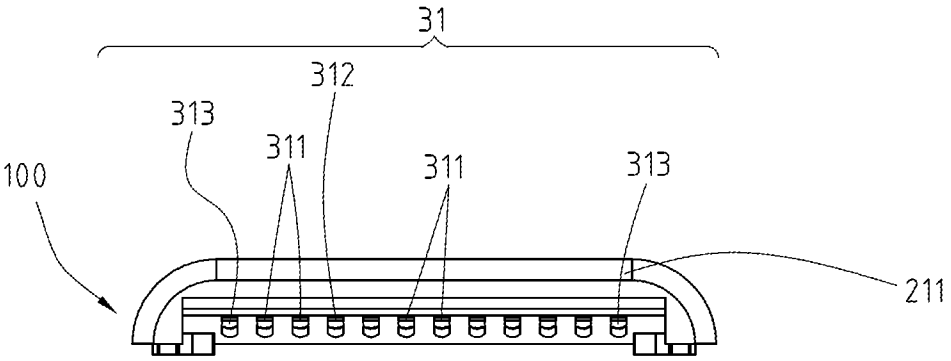
FIG. 13 illustrates a front view of the electrical plug connector according to the second embodiment.

Additionally, in this embodiment, the insulated housing 21 comprises a first groove 25 formed at the rear of the portion (the first portion 211 or the second portion 212) and adjacent to the base portion 210, as shown in FIG. 12. The formation of the first groove 25 is described as below. In the insert molding procedure, the insulated housing 21 is received in a mold having a plurality of processing fixtures. After the insulated housing 21 is molded, the rear of the portion forms a first groove 25. Then, pressing fixtures can be inserted into the first groove 25 to cut the cut portions 33 (i.e., to break the extending portions 32). Therefore, the first plug terminals 31 or the second plug terminals 41 can be separated with each other by breaking the extending portions 32.

Furthermore, in this embodiment, the insulated housing comprises a plurality of second grooves 26, as shown in FIG. 12. The second grooves 26 may be directly formed on the first portion 211 or the second portion 212 after the insulated housing 21 is insert-molded. The second grooves 26 respectively correspond to the flexible contact portions 315 of the first plug terminals 31 or the flexible contact portions 415 of the second plug terminals 41. The second grooves 26 are adjacent to the front stopping portion 221. In other words, the second grooves 26 are positioned corresponding to the first plug terminals 31 or the second plug terminals 41 to provide the flexible contact portions 315 or 415 with a swinging room. Specifically, when the flexible contact portions 315 or 415 are in contact with an electrical receptacle connector, the flexible contact portions 315 or 415 are bent in the second grooves 26.

Please refer to FIG. 2, FIG. 7, and FIG. 12, a formation method of the insulated housing 21 of the instant disclosure comprises:

Step S11: start.

Step S12: providing a coloring process to color the insulated housing 21.

Step S13: in the step S12, the coloring process is to provide color plastic particles to the insulated housing 21 during the insert-molding procedure.

Step S14: in the step S12, the coloring process is to color the surface of the molded insulated housing 21 by dyes, pigments, paintings, or coatings.

Step S15: finish.

In this embodiment, the insulated housing 21 described in the first embodiment or the second embodiment is further processed to have a specific color layer 81 (e.g. pale green, pale blue, etc.). Illustrative embodiments of the formation of the color layer 81 are described as below. The color layer 81 of the insulated housing 21 may be formed by applying a coloring process in which color plastic particles are added into the raw material of the insulated housing 21 during the insert-molding procedure, so that the product of the insulated housing 21 would have the color layer. Alternatively, the coloring process may be coloring the surface of the molded insulated housing 21 by dyes, pigments, paintings, or coatings. Moreover, the insulated housing 21 may have one or more color, and the color may be applied to a portion or the whole of the insulated housing 21. As a result, the beauty of the electrical plug connector 100 can be improved. Moreover, the color may be provided for distinguishing electrical plug connectors 100 with different connection interfaces or different transmission specifications.

According to embodiments of the instant disclosure, the outer iron shell, the EMI pieces and insulated pieces at the outer iron shell are reduced, so that the electrical plug connector can be assembled rapidly, and the cost can meet the criteria of a cheaper connector. The appearance of the insulated housing is in compliance with the specification of USB Type-C connector, and the insulated housing can be firmly mated with an electrical receptacle connector (Type-C receptacle connector). In addition, the plug terminals are aligned in a single row, and the number of the plug terminals can be reduced for basic power or signal transmission, according to user requirements. Alternatively, the plug terminals may be aligned in two rows, and the number of the plug terminals can be reduced for basic power or signal transmission, according to user requirements.

In addition, in some embodiments, the insulated housing comprises the semi-tubular portion. The insulated housing having the semi-tubular portion can also meet the USB Type-C connection interface and can be mated with an electrical receptacle connector (Type-C receptacle connector). Consequently, the cost of the insulated housing can be reduced, and the structure of the insulated housing is simple and can be manufactured easily.

Moreover, a color layer may be provided on the insulated housing to improve the beauty of the electrical plug connector. In addition, the color may be provided for distinguishing electrical plug connector with different connection interfaces or different transmission specifications.

What is claimed is:

1. An electrical plug connector, comprising:

an insulated housing comprising a base portion, a semi-tubular portion, and a first groove, wherein the semi-tubular portion is extending from one side of the base portion, the semi-tubular portion comprises a first portion, a front stopping portion at a front lateral surface of the first portion, and a plurality of side blocks extending outward from two sides of the first portion, wherein the first portion has a first mating surface, and wherein the first groove is foiled at the rear of the first portion and adjacent to the base portion; and a plurality of first plug terminals comprising a plurality of signal terminals, at least one power terminal, and at least one ground terminal, wherein the first plug terminals are held in the insulated housing and at the first mating surface of the first portion.

2. The electrical plug connector according to claim 1, wherein each of the first plug terminals comprises a flexible contact portion, a body portion, and a tail portion, wherein the body portion is held in the first portion, the flexible contact portion is extending forward from the body portion in the rear-to-front direction and partly exposed upon the first mating surface of the first portion, the tail portion is extending backward from the body portion in the front-to-rear direction and protruded from the insulated housing.

3. The electrical plug connector according to claim 2, further comprising a rear block fixed at the rear of the insulated housing, wherein the rear block comprises a plurality of through grooves, and the tail portions are held in the through grooves, respectively.

4. The electrical plug connector according to claim 2, wherein the insulated housing comprises a plurality of second grooves, the second grooves are formed on the first portion and respectively correspond to the flexible contact portions of the first plug terminals.

5. The electrical plug connector according to claim 1, wherein the first plug terminals comprise a plurality of extending portions, and the first plug terminals are separated from each other by breaking the extending portions and a plurality of cut portions are formed, wherein the cut portions correspond to the first groove and are exposed out from the first groove.

6. An electrical plug connector, comprising:

an insulated housing comprising a base portion, and a semi-tubular portion, wherein the semi-tubular portion is extending from one side of the base portion, the semi-tubular portion comprises a first portion, a front stopping portion at a front lateral surface of the first portion, and a plurality of side blocks extending outward from two sides of the first portion, wherein the first portion has a first mating surface;

a plurality of first plug terminals comprising a plurality of signal terminals, at least one power terminal, and at least one ground terminal, wherein the first plug terminals are held in the insulated housing and at the first mating surface of the first portion; and a plurality of engaging portions at the insulated housing, wherein each of the engaging portions comprises a hook portion and a protruded contact portion, the protruded contact portion is extending from the front of the hook portion and toward the first mating surface of the first portion, and the hook portions are respectively fixed with the two sides of the insulated housing.

7. The electrical plug connector according to claim 6, wherein the insulated housing has through slots at two sides thereof for positioning the engaging portions.

8. An electrical plug connector, comprising:

an insulated housing comprising a base portion, a tubular portion, and a mating room, wherein the tubular portion comprises a first portion and a second portion, and the tubular portion is extending from one side of the base portion, and the mating room is between the first portion and the second portion, wherein the first portion has a first mating surface, the second portion has a second mating surface, and the first mating surface faces the second mating surface;

a plurality of first plug terminals comprising a plurality of signal terminals, at least one power terminal, and at least one ground terminal, wherein the first plug terminals are held in the insulated housing and at the first mating surface of the first portion; and a plurality of engaging portions at the insulated housing, wherein each of the engaging portions comprises a hook portion and a protruded contact portion, the protruded contact portion is extending from the front of the hook portion and inserted into the side portion of the mating room, and the hook portions are respectively fixed with the two sides of the insulated housing.

9. The electrical plug connector according to claim 8, wherein each of the first plug terminals comprises a flexible contact portion, a body portion, and a tail portion, wherein the body portion is held in the first portion, the flexible contact portion is extending forward from the body portion in the rear-to-front direction and partly exposed upon the first mating surface of the first portion, the tail portion is extending backward from the body portion in the front-to-rear direction and protruded from the insulated housing.

10. The electrical plug connector according to claim 8, wherein the insulated housing comprises a plurality of first grooves formed at the rear of the first portion and the rear of the second portion, and the first grooves are adjacent to the base portion.

11. The electrical plug connector according to claim 8, further comprising a plurality of second plug terminals, wherein the second plug terminals comprises a plurality of signal terminals, at least one power terminal, and at least one ground terminal, wherein the second plug terminals are held in the insulated housing and at the second mating surface of the second portion.

12. The electrical plug connector according to claim 11, wherein the first plug terminals and the second plug terminals have 180 degree symmetrical design with respect to a central point of the mating room as the symmetrical center.

13. The electrical plug connector according to claim 11, wherein each of the second plug terminals comprises a flexible contact portion, a body portion, and a tail portion, wherein the body portion is held in the second portion, the flexible contact portion is extending forward from the body portion in the rear-to-front direction and partly exposed upon the second mating surface of the second portion, the tail portion is extending backward from the body portion in the front-to-rear direction and protruded from the insulated housing.

14. The electrical plug connector according to claim 13, further comprising a rear block fixed at the rear of the insulated housing, wherein the rear block comprises a plurality of through grooves, and the tail portions of the first plug terminals and the tail portions of the second plug terminals are held in the through grooves, respectively.

15. The electrical plug connector according to claim 13, wherein the insulated housing comprises a plurality of second grooves, the second grooves are formed on the first portion and the second portion, and the second grooves respectively correspond to the flexible contact portions of the first plug terminals and the flexible contact portions of the second plug terminals.

16. The electrical plug connector according to claim 11, wherein the position of the first plug terminals corresponds to the position of the second plug terminals.

17. The electrical plug connector according to claim 8, wherein the insulated housing has through slots at two sides thereof for positioning the engaging portions.

* * * * *